United States Patent [19]

Mann et al.

[11] Patent Number: 4,648,660

[45] Date of Patent: Mar. 10, 1987

[54] METHOD AND APPARATUS FOR MINING MACHINE CUTTER HEAD

[75] Inventors: John P. Mann, Worthington; Victor M. Levenstein, Reynoldsburg; Charles H. Fox, Greenville, all of Ohio

[73] Assignee: Dresser Industries, Inc., Dallas, Tex.

[21] Appl. No.: 727,682

[22] Filed: Apr. 26, 1985

[51] Int. Cl.[4] ..... E21C 27/24

[52] U.S. Cl. ..... 299/10; 299/76; 299/78

[58] Field of Search ..... 299/10, 76, 78; 74/325

[56] References Cited

U.S. PATENT DOCUMENTS

| | | | |
|---|---|---|---|
| 3,305,273 | 4/1964 | Kilbourne | 299/78 |
| 3,730,593 | 5/1973 | Karlovsky, Jr. | 299/76 |
| 3,783,710 | 1/1974 | Steinhagen | 74/325 X |
| 4,200,335 | 4/1980 | Moynihan et al. | 299/10 X |
| 4,253,705 | 3/1981 | Le Beque | 299/76 |

*Primary Examiner*—Stephen J. Novosad
*Assistant Examiner*—Thomas J. Odar

[57] ABSTRACT

An improved cutting head for a mining machine having a rotary cutting head and shaft removably and rotatably attached to the forward end of a mining machine such that the shaft and cutting head alone may be removed from the forward end of the machine and repaired at the site where the mining is taking place.

14 Claims, 7 Drawing Figures

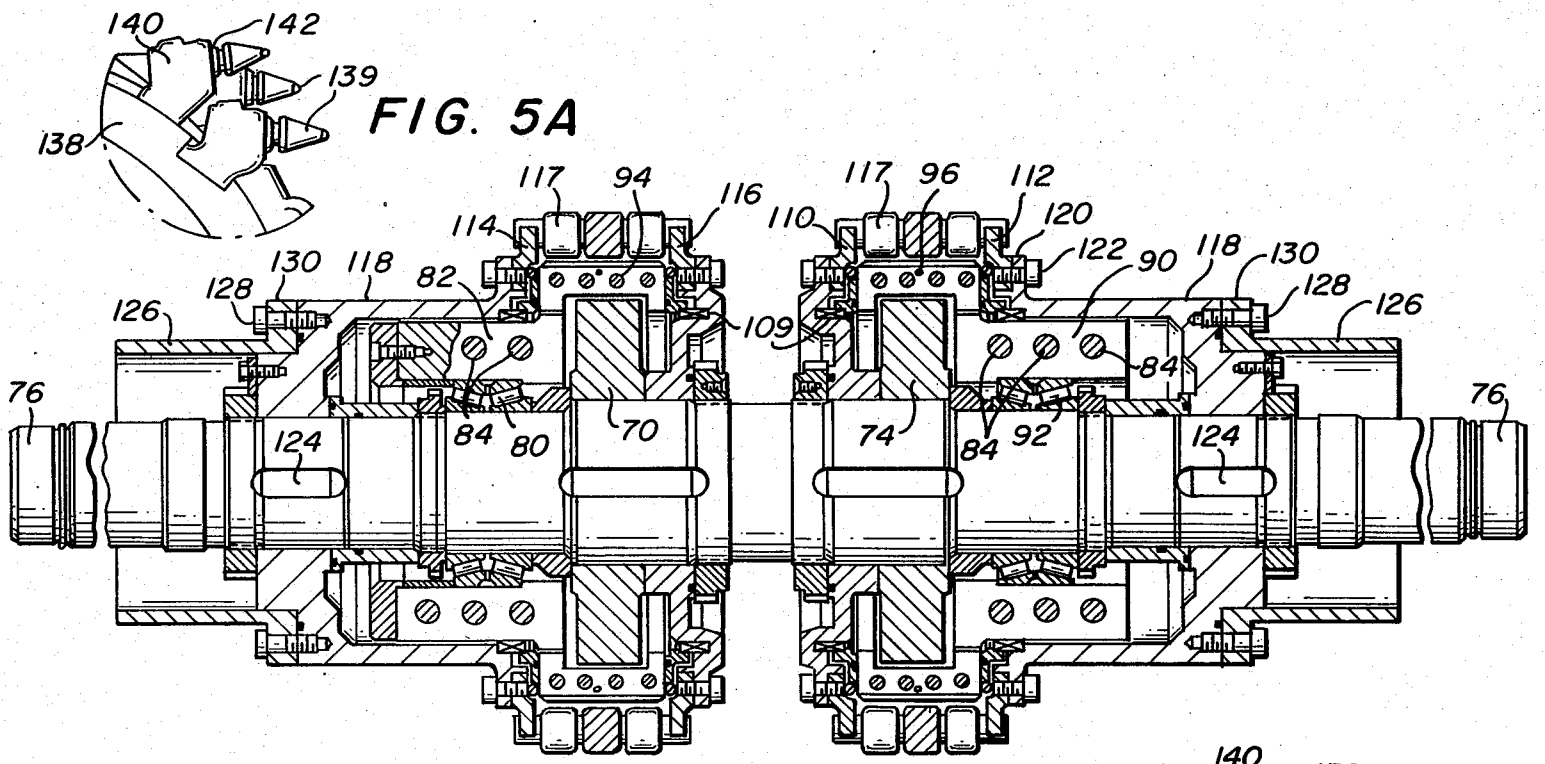
FIG. 4
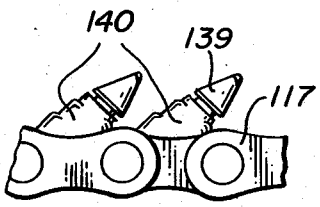
FIG. 5B
FIG. 5A

METHOD AND APPARATUS FOR MINING MACHINE CUTTER HEAD

BACKGROUND OF THE INVENTION

The present invention relates to mining machines in general and in particular to an improved cutter head for a mining machine which is so constructed that it allows the cutting head to be disassembled and repaired where the mining is taking place.

Continuous mining machines are characterized by a cutting head at the front end of the machine, gathering means to collect the mined material, also disposed at the front end of the mining machine, and conveying means to move the mined material to the rear of the mining machine to be discharged to a car or other conveyance for moving the material out of the mine. The cutting head is adapted to be advanced into the mine face and is operated in and over the mine face to cut and break the material out of the mine face. The mined material falls to the mine floor and is collected by the gathering means and swept into the conveyor of the machine. The conveyor extends longitudinally from the front end of the mining machine to the rear end of the machine and moves the material along the machine and discharges the material at the rear end of the machine. The mining machine, of course, is equipped with suitable traction means which may be endless crawler traction treads by which the machine is propelled. Such traction means propells the mining machine forwardly to advance the cutting head into the mine face.

The prior art continuous mining machines have two motors which are disposed, one on each side of the machine and provide the power for operating the several mechanisms of the machine. The motors are continuously operated to provide a continuous source of power during the operation. There is a mechanical transmission driving means from the motors to the cutting head by which the cutting head is driven.

The mining machine has a frame assembly pivotally attached thereto and the cutting head is mounted on the outer end thereof along with the drive motors and the transmission driving elements from the motors to the cutting head. It will be realized that the cutting head is a large rotatable unit having cutting teeth about the periphery thereof and that the motors which drive it, usually electric motors, are very large motors in the order of several hundred horsepower. First and second hydraulic rams or cylinders are coupled to the frame assembly for moving it upwardly and downwardly across the face of the material to be mined whereby the cutting head removes the material from the mine face as the frame assembly is moving the cutter head upwardly or downwardly. Obviously, the horizontal motion of the cutting head can be controlled by steering the mining machine itself.

Because of the large size of the cutting head, the drive motors and the mechanical transmission coupling the two, and because of the tremendous stresses which are placed on the various components in the mining of material such as anthracite coal, the components of the mining machine, and in particular the cutting head, the drive motors and the mechanical transmission, are subject to wearing or breakage and from time to time need to be repaired or replaced.

The problem with the prior art mining machines in this respect is that the entire pivotable frame assembly including the cutting head, the drive motors and the transmission linkage, has to be removed from the mining machine and taken to the earth's surface outside the mine for repair. This occurs because the frame assembly and the elements attached thereto are formed as an integral unit and therefore when the cutting head assembly has to be removed, the transmission linkage and drive motors must also be removed. This, of course, requires the need for special equipment and so the entire frame assembly has to be removed from the mining machine and taken to the surface where special tools can be available to separate the integral components and repair whatever is needed. As can be seen in U.S. Pat. No. 3,495,876, the mining machine disclosed therein has a cutting head assembly disposed at the outer end of a frame assembly and is driven by electric motors through a gear linkage as shown in FIG. 4 thereof. The integral construction of the unit does not allow the disassembly of the cutting head unit without also disassembling the transmission assembly which couples the drive motors to the cutting head. Such a mining machine assembly is also disclosed in U.S. Pat. No. 3,516,712 which also has the same problem.

The present invention overcomes the disadvantages of the prior art by providing a mining machine with a frame assembly having a cutting head assembly which is removably mounted or attached to the outer end of the frame assembly whereby the cutting head can be separately removed from the frame assembly of the mining machine where the mining is taking place.

In addition, the cutting head is itself formed of a shaft having at least one bearing attached thereto and at least one drive gear attached thereto. The cutting elements are formed in cylindrical segments and encircle and are rigidly attached to the shaft. A split housing is formed on the outer end of said frame assembly with one-half of the housing being integrally formed as part of the frame and the other half of the housing being removably attached to the frame assembly about the shaft bearings so that the shaft is carried by the bearings at the front end of the frame assembly. If two motors are used to drive the shaft, then two bearings are formed on the shaft and each one is held in a corresponding split housing. First and second intermediate cutting elements having cutting bits rigidly attached to the outer surface or periphery thereof which encircle the shaft as well as the bearing housings so that the bearing housings are totally located within the first and second cutting elements. The third and fourth cutting elements are also cylindrical in shape and encircle the shaft and are rigidly attached to the outer ends of the first and second cutting elements respectively. The third and fourth cutting elements also have cutting bits rigidly attached to the outer periphery thereof.

The drive gear on the cutting head shaft is driven by the drive motor gear through an idler gear. An end cap is formed over each of the drive gears attached to the cutting head drive shaft to form a sealed housing in which the drive gear is protected while it rotates.

Since no rotation of the cutting heads can take place over the end cap covering the drive gear on the cutting head drive shaft, first and second sprockets are placed on the sides of the end cap covering the drive gear and are rigidly attached to the shaft. An endless chain is driven by the sprockets and is carried at the other end by a roller or an idler sprocket and cutting bits or teeth are placed on the chain so that the entire cutting head has a continual cutting surface.

The idler gear which couples the drive motors to the gear on the cutting head shaft is mounted on an eccentric collar about a rigid shaft. When the eccentric collar is placed in a first position, it allows the idler wheel gear which is placed thereon to couple the motor driving gear to the shaft driven gear with a particular gear ratio and thus allows the cutter head to be driven at a particular speed for any given RPM of the drive motor. If the eccentric collar is rigidly attached in a second position, it allows a larger idler gear and a smaller size motor driving gear to be installed to cause the cutter head shaft driven gear to achieve a different speed of rotation. Thus, the cutting head assembly obtains a different rotational speed for the same given RPM of the drive motor.

Thus, it is an object of the present invention to provide a mining machine which has a cutting head that can be disassembled and repaired in the location where the mining is taking place.

It is also an object of the present invention to construct the cutting head in segments that can be individually removed so that disassembly of the unit at the location where the mining is taking place is relatively simple.

It is still a further object of the present invention to provide an improved mining machine in which the cutting head speed can be changed simply by changing the size of the motor drive gear and the idler gear coupled to the cutter head drive gear through the use of an eccentric collar placed about a rigid shaft for the idler gear.

SUMMARY OF THE PRESENT INVENTION

The present invention therefore relates to a continuous mining machine having a frame assembly pivotally attached to said machine and a rotary cutting head mounted on a shaft on the forward end of said frame assembly for cutting loose mining material from the face of a mine and extending beyond each side of said frame assembly and to the improvement comprising a cutter head support housing formed on the forward end of said frame assembly, means for removably and rotatably attaching said rotary cutting head and shaft to said support housing on said forward end of said frame assembly whereby said shaft and cutting head alone may be removed from said frame assembly and repaired where said mining is taking place, and drive means coupled to said cutting head shaft to provide rotary motion thereto for cutting mining material.

The invention also relates to an improved method of mining material with a mining machine having a frame assembly pivotally attached to said machine and a rotary cutting head assembly mounted on a shaft on the forward end of said frame assembly for cutting loose mining material from the face of a mine and extending beyond each side of said frame assembly, the improvement comprising the steps of forming said cutting head assembly with a shaft and at least first and second removable cutting elements attached thereto, said cutting elements being cylindrical in shape and having cutting bits on the outer surface thereof and removably encircling said shaft, said shaft including at least one bearing and at least one drive gear, mounting said cutting head assembly on the outer end of said frame assembly by placing said shaft bearing in a first half of a bearing support integrally formed on the outer end of said frame assembly and mating a second half of said bearing support to said first half over said bearing to hold said shaft in a rotatable relationship with said frame assembly, and coupling a drive motor on said frame assembly to said cutting head shaft drive gear for rotating said cutting head whereby said cutting head may be disassembled and repaired where the mining is occurring.

BRIEF DESCRIPTION OF THE DRAWINGS

These and other advantages of the present invention will be disclosed more fully in connection with the accompanying drawings in which:

FIG. 4 is a cross-sectional view of the auger shaft assembly illustrating the drive gears, the support bearings, the intermediate and straight cutting elements which encircle the shaft as well as the sprocket assemblies which carry the cutting chains having cutting bits thereon;

FIGS. 5A and 5B are partial diagrammatic representations of the cutting bits.

DETAILED DESCRIPTION OF THE DRAWINGS

Figure 1:
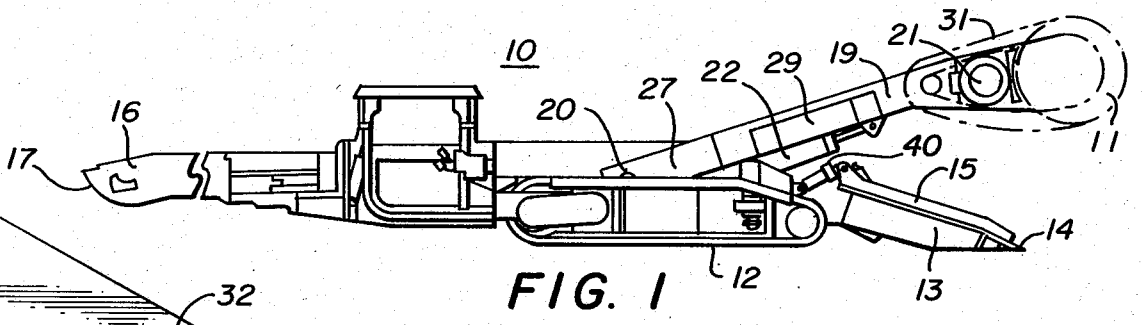
FIG. 1 is a side elevation view of a prior art mining machine which can be modified to incorporate the present invention.

FIG. 1 is a side view of a typical mining machine of the prior art which can be modified to utilize the present invention. The mining machine is generally designated by the numeral 10 having a rotating cutting head 11. The mining machine 10 is moved or propelled by endless traction treads 12 disposed on each side of the machine. The endless traction treads 12 are driven through a drive transmission by electric motors 27.

A gathering head 13 is pivotally mounted on the front of the mining machine 10. The gathering head 13 comprises an apron 14, the forward end of which is disposed on the mine floor. There are gathering arms 15 on each side of the apron 14 and these operate to gather the mined material from the mine floor onto the apron 14 and to sweep the mined material onto the chain driven conveyor 16 which extends from the forward end of the mining machine 10 to the rear end thereof. The conveyor 16 runs from the gathering head 13 to the conveyor discharge boom 17 which is also pivotally mounted on the mining machine 10.

The gathering head 13 is pivotally mounted on the mining machine 10 and operated by means of hydraulic cylinders 40 mounted on each side of the machine.

Thus, the gathering head 13 may be adjusted upwardly and downwardly to follow an uneven mine floor and thereby to maintain the leading edge of the apron 14 on the mine floor for maximum effectiveness in loading the mined material onto the conveyor 16.

The mining machine 10 has a cutting head 11 which is pivotally mounted on the mining machine 10 for movement upwardly and downwardly. The cutting head 11 is supported on the mining machine 10 by a pivotable frame assembly including a pair of arms 19 which extend from a pivot 20 to the cutting head 11. There are two hydraulic cylinders 22 which are connected to the arms 19 to raise and to lower arms 19 and the cutting head 11 on the outer end thereof. Thus, it can be seen that motor 27 drives the cutting head 11 through a mechanical linkage arrangement 29 and gear transmission 21.

The cutting head 11 includes a plurality of spirally arranged cutting bits 139 (shown in FIG. 2 and FIG. 5A and 5B) and a pair of cutting chains 117 (shown in FIG. 3) which are also provided with a plurality of cutting bits to provide a continuous cutting surface.

Since the entire frame assembly from pivot point 20 through arms 19 and cutting auger 11 is an integrally formed unit, if any repair needs to be done on cutting head 11, or gear train 21 or motors 27, the entire frame assembly must be disconnected at pivot point 20 and at hydraulic cylinders 22 and removed outside the mine where special tools can be used to disassemble the unit and repair the part that is malfunctioning. It will be understood, of course, that since this equipment is so large it is a tedious, complex and very time consuming operation to remove the entire frame assembly from the unit and take it on the outside of the mine for repair.

Figure 2:
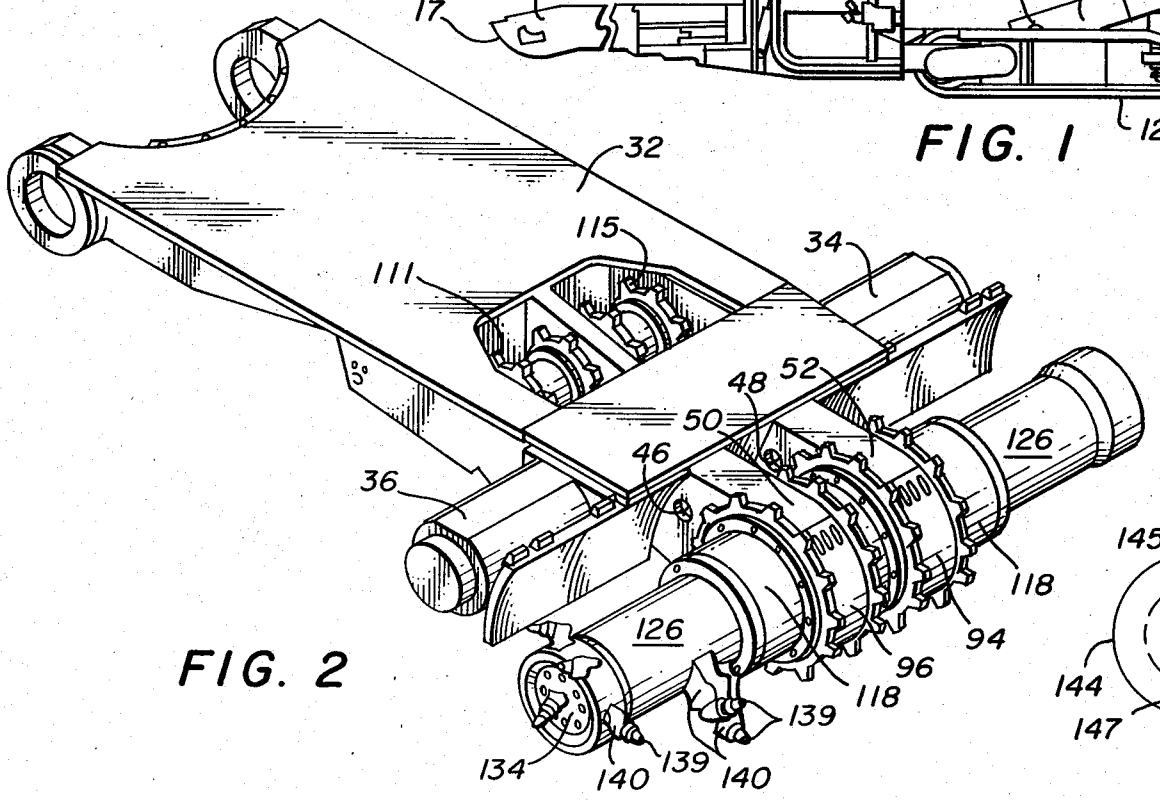
FIG. 2 is a simplified representation of the mining machine pivotable frame assembly which has a bearing support integrally formed on the outer end of the frame assembly for removably attaching the cutting head shaft to the outer end of the frame assembly.
Figure 3:
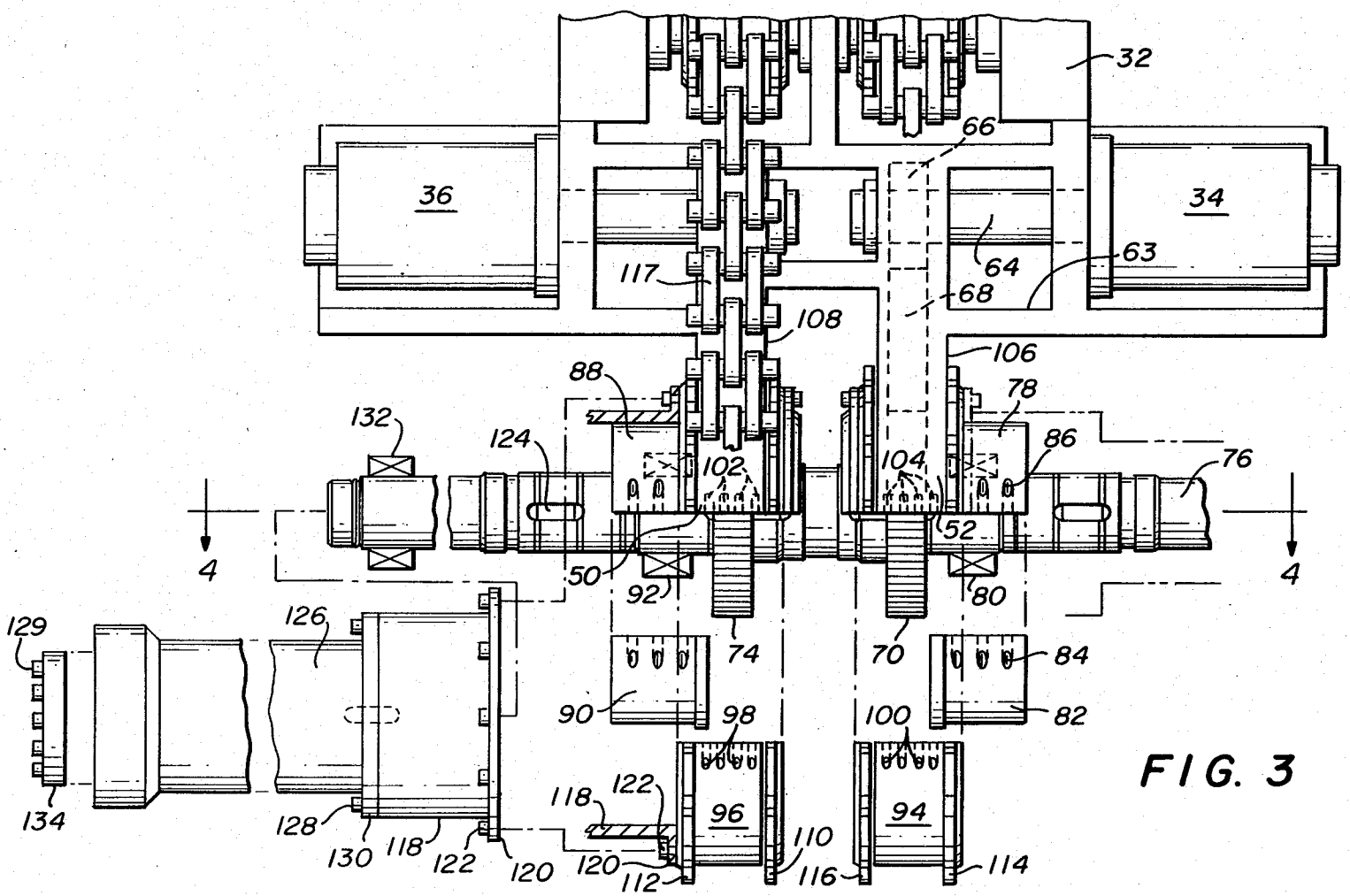
FIG. 3 is a top view of a diagrammatic representation of the outer end of said frame assembly showing the integrally formed one-half of the cutting head bearing support frame and how it and the mating half of the cutting head bearing support frame holds the cutting head shaft in rotatable relationship to the outer end of the frame assembly along with the relationship of the gear drives and the cutting elements that encircle and are removably attached to the cutting head shaft.

FIG. 2 is a perspective view of a novel frame assembly for the present invention which can be used on the machine shown in FIG. 1 and on which can be mounted the drive motor, gear trains and cutting head, all of which can be disassembled in the mine where the mining operation is taking place and repaired without removing the entire frame assembly. The novel frame assembly 32 shown in FIG. 2, has drive motors 34 and 36 mounted thereon and are easily removable. The cutting head support housings 78 and 88 shown in FIG. 3 are C-shaped bearing housings and are integrally formed on the outer end of the frame assembly 32 and form a first half of a bearing support assembly for retaining the cutting head shaft bearings. Further, simple idler gears may be mounted at orifices 46 and 48 to directly couple the drive gear from the motors 34 and 36 to the drive gears on the cutting head shaft. A first half of a gear chamber is also formed at 50 and 52 on the outer end of the frame assembly 32 for receiving the drive gears on the cutting head shaft.

A second half 90 of said cutting head support housing or C-shaped bearing support (shown in FIG. 3) mates with the integrally formed half 88 and encircles the cutting head shaft bearing (shown in FIG. 3) while the second half 82 of the cutting head support housing or bearing support (shown in FIg. 3) mates with integrally formed half 78 to encompass and retain the other bearing on the cutting head shaft (shown in FIG. 3). A first C-shaped cap 96 also mates with the integrally formed channel 50 on frame assembly 32 in which the drive gear for the cutting head shaft will be located while C-shaped end cap 94 mates with the integrally formed channel 52 which will retain the other drive gear for the cutting head shaft. Thus, the cutting head shaft is removably mounted in split halves or matching C-shaped sections of the cutting head support housings 88 and 90 and 78 and 82 which are bearing supports as shown in FIG. 3. In addition, the drive gears which are attached to the cutting head shaft are also covered by C-shaped end caps 94 and 96 to protect them from contaminants and to maintain the oil supply in which they rotate.

FIG. 3 is a diagrammatic representation of the outer end of the frame assembly 32 illustrating the manner in which the drive motors are connected to the cutting head shaft and how the cutting head shaft is removably mounted at the outer end of the frame assembly so that it can be easily dismantled and repaired in the field at the site of the mining. Thus, drive motor 34 produces an output on shaft 64 which is coupled to a drive gear 66 and all of which are mounted toward the outer end of frame assembly 32. While shaft 64 is shown in space 63, in actual operation, a planetary gear train would occupy space 63 to give the proper gear ratios. Drive gear 66 is coupled through an idler gear 68 to shaft drive gear 70 mounted on cutting head shaft 76. A second drive motor 36 is coupled through a similar set of gear trains to shaft drive gear 74 which is also attached to the cutting head shaft 76.

As can be seen in FIG. 3, a first half 78 of a bearing support is integrally formed on the outer end of frame assembly 32 to receive the removable mating second half 82 of said bearing support to support the bearing 80 of cutting head shaft 76. Bolts are placed through orifices 84 in mating support 82 which extend into tapped orifices 86 in the first half 78 of the bearing support which is integrally formed on the outer end of frame assembly 32. A similar split bearing housing comprising the integrally formed portion 88 and the removable portion 90 holds bearing 92 on the other side.

Since shaft gears 70 and 74 are exposed, gear caps 94 and 96 are placed over gears 70 and 74 respectively and attached with bolts through orifices 98 and 100 respectively to tapped orifices 102 and 104 in the integrally formed portions 50 and 52 on the outer end of frame assembly 32. Because frame portions 106 and 108 are enclosed arms which house the gear train assembly, no cutting element can be rotatably located in this area about shaft 76. In order therefore to insure that cutting occurs in this area, sprocket assemblies 110 and 112 are placed on either side of the end cap 96 and attached to shaft 76 and sprocket assemblies 114 and 116 are placed on either side of gear cap 94 and attached to shaft 76 thereby allowing an endless chain 117 to be driven thereby with the endless chain 117 passing over frame portions 106 and 108 to idler rollers or sprockets 115 and 111 located elsewhere on frame assembly 32 as shown in FIG. 2. These sprocket assemblies 110, 112, 114 and 116 are rigidly attached to shaft 76 in any well known manner thereby having rotated power applied thereto.

A first intermediate cutting element 118 is attached for rotation to shaft 76. Only one of the intermediate cutting elements 118 is shown for purposes of simplicity of the drawings since the other side would be identical. Cutting element 118 would have cutting bits 139 mounted in frames 140 rigidly attached to the cutting element 118 as shown in FIG. 5A. Cutting element 118 is cylindrical in shape and encircles the cutting head shaft 76 and thus encircles and covers the unitary housing assembly for bearing 92 which housing assembly is formed by the first half 88 of the bearing support and the second half 90. A flange 120 is formed about the circumference of the inner end of cutting element 118 and bolts 122 are placed therethrough for attachment to sprocket 112. A keyway 124 on shaft 76 may be used to lock cutting element 118 to shaft 76 and absorb the stress.

A second outer cutting element 126 also has cutting bits thereon in a manner similar to that shown in FIG. 5A and is cylindrical in shape and encircles auger shaft 76 and is attached to the outer end of cutting element 118 by means of bolts 128 passing through a flange 130 into orifices (not shown) in cutting element 118. An outer bearing 132 may be placed about shaft 76 to support the outer end of third cutting element 126. An end plate 134 may be attached to the outer end of outer cutting element 126 by means of bolts 129 to close the end thereof and protect bearing 132. Obviously, the second outer cutting element on the opposite side would be identical to cutting element 126 and therefore is not shown in the drawing for purposes of simplicity.

Thus, it can be seen in FIG. 3 that the individual cutting elements 118 and 126 on either side of the cutting head can be easily removed if necessary for repairs. In addition, by removing cutting elements 118 and 126 on both sides, the bearing support caps 82 and 90 are uncovered and can be removed along with endless chains 117 and gear caps 94 and 96 can be removed and the entire shaft 76 can be easily removed from the frame assembly 32 for purposes of repair. In addition, of course, it is easy to reach either the drive motor 34 or 36 and its associated drive gear 66 or the idler gear 68 in order to make any repairs that are necessary. Thus, the frame assembly as shown in FIG. 2 when modified as shown in FIG. 3 does not have to be removed for repairs and only those components necessary can be removed as shown in FIG. 3 for purposes of repair.

FIG. 4 is a detailed cross-sectional view of the cutting head assembly taken along lines 44 of FIG. 3. Thus, cutting head shaft 76 has mounted thereon drive gears 70 and 74. Bearings 80 and 92 encircle shaft 76 and are held in place with end caps 82 and 90 respectively by means of bolts 84. Sprocket assemblies 110 and 112 are located on each side of gear cap 96 and driven by shaft 76 while sprockets 114 and 116 are placed on the sides of gear cap 94 and are likewise driven by shaft 76. Seals 109 make the gear caps 94 and 96 liquid tight.

An intermediate auger 118 is cylindrical in shape and surrounds shaft 76 and is attached thereto through means of a keyway 124. It is also attached to sprocket assembly 112 by means of bolts 122 passing through flange 120.

A second cutting assembly 126 is also cylindrical in shape and surrounds shaft 76 and is attached to the outer end of first cutting assembly 118 by means of bolts 128 passing through flange 130 into the end of first cutting assembly 118. Since both sides of the cutting head assembly are identically constructed the other side will not be explained in detail but it will be understood that it is assembled in the same fashion as described for the right side. A chain 117 having cutting bits thereon is driven by sprockets 110, 112 and a similar chain 117 would be driven by sprockets 114 and 116.

FIG. 5A discloses the manner in which the cutting bit fixtures 140 are integrally formed with the body 138 of a cutting assembly such as by welding. Cutting bits 139 are removably attached in orifices 142 so that as they wear out they can be replaced. These cutting bits are placed along the outer portion of end plates 134 of the second cutting assemblies 126 as well as arranged in a spiral relationship about the circumference of the cutting elements 126 and also form a part of the endless chains 117 as shown in FIG. 5B so that a complete and continuous cutting element will be provided from one end to the other as the cutting elements rotate.

Figure 6:
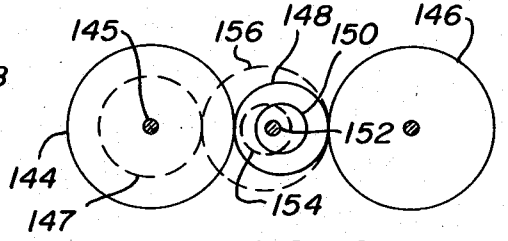
FIG. 6 is a diagrammatic representation of the idler gear which couples the drive motor gear to the cutting head shaft gear and the manner in which an eccentric collar is used to enable two different sizes of idler gears and motor drive gears to be used thereby allowing different speeds of operation of the cutting head assembly with the same RPM of the drive motor.

From time to time it may be necessary to change the speed of the rotation of the cutting elements with respect to the driving motor for any given RPM of the driving motor 34 and 36. In the present case, this is accomplished simply by placing an idler gear between the motor driven gear and the cutter head assembly shaft gear and mounting it on an eccentric collar which can be moved from a first position in which one size idler gear can be used to couple the driving gear to the driven gear and to a second position where a larger idler gear can couple a smaller driving gear to the driven gear, for instance. Thus, in FIG. 6 driving gear 144 is mounted on shaft 145 and coupled to driven gear 146 through an idler gear 148. It will be noted that idler gear 148 rotates about a collar 150 which is eccentrically and fixedly attached to rigid shaft 152 in any well known manner such as by a keyway (not shown). In this relationship, a specific gear ratio is obtained between driving gear 144 and driven gear 146 through idler gear 148.

If it is desired that the driven gear 146 turn at a different rate for any given RPM of the driving gear 144, the eccentric collar 150 is simply moved to a second position shown by dashed lines 154 about shaft 152 and again fixedly attached thereto in any well known manner. This now allows a larger gear shown by dashed lines 156 to be mounted on the eccentric collar 154 and a smaller gear 147 attached to shaft 145 thus having a higher gear ratio than before and driven gear 146 now turns at a slower rate for the same given RPM of the driving gear 144. Thus, by mounting the eccentric collar 150 in a first position on the fixed shaft 152, a first idler gear 148 can be placed thereon to couple a first motor drive gear 144 to the cutting head shaft drive gear 146 to obtain a first gear ratio on a first speed of the cutting shaft at a given drive motor RPM. By mounting the eccentric collar in a second position 154 on the fixed shaft 152, a second larger idler gear 156 may be placed thereon to couple a second smaller motor drive gear 147 to the cutting head shaft drive gear 146 to obtain the second gear ratio and the second speed of the cutting head shaft at a given drive motor RPM. Thus, a simple way is provided to change the gear relationship between the driving motor and the rotating cutting head and can easily be accomplished at the mining location.

Thus, there has been disclosed a novel cutting head assembly for a mining machine whereby the cutting head may be easily removed from the frame assembly and repaired where the mining is taking place. Not only is the cutting head assembled in components which can be removed one at a time as necessary for repairs but also the entire cutting head shaft, bearings and gears can be removed to allow the most detailed repairs at the site of the mining operation rather than having to remove the entire frame assembly with the drive motor, the drive transmission and the cutting head assembly all mounted thereon for repair at a remote location.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined in the appended claims.

I claim:

1. In a continuous mining machine having a frame assembly pivotally attached to said machine and a rotary cutting head mounted on a shaft on the forward end of said frame assembly and having cutting bits thereon for cutting loose mining material from the face of a mine and extending beyond each side of said frame assembly, the improvement comprising:

a. at least one bearing mounted on said cutting head shaft for enabling rotation of said shaft, b. at least one C-shaped bearing support housing on the forward end of said frame assembly for receiving said bearing on said shaft, c. a matching removable C-shaped bearing support end cap for attachment to said frame assembly C-shaped bearing support housing for encompassing and supporting said shaft bearing for rotation of said shaft whereby said shaft may be removed from said mining machine without lateral movement of said shaft by removing said matching removable C-shaped bearing support housing, and d. drive means coupled to said cutting head shaft to provide rotary motion thereto for cutting mining material.

2. An improved mining machine as in claim 1 further including:

a. first and second cylindrical cutting elements encircling said shaft and removably attached one on each side of said drive means respectively, and b. cutting bits formed about the periphery of said cutting elements.

3. An improved mining machine as in claim 2 further including:

a. third and fourth outer cutting elements encircling said shaft and removably attached to said shaft and to the outer end of respective ones of said first and second cutting elements, and b. cutting bits formed about the periphery of said third and fourth cutting elements whereby said first, second, third and fourth cutting elements may be removed from said shaft and repaired at the site where said mining is taking place without removing said frame assembly from said machine.

4. An improved mining machine as in claim 3 wherein said drive means comprises:

a. at least one drive motor mounted on said frame assembly and coupled to and rotating a drive gear, b. at least one cutting head drive gear mounted on said cutting head shaft, and c. an idler gear coupling said motor drive gear to said cutting head shaft drive gear for rotating said cutting head shaft.

5. An improved mining machine as in claim 4 further including:

a. an eccentric collar rotatably mounted about a fixed shaft in proximity to said motor drive gear and said cutting head shaft drive gear, b. means for positioning said collar in a first position on said fixed shaft whereby a first diameter idler gear wheel placed thereon will couple said motor drive gear to said cutting head shaft drive gear to obtain a first gear ratio and a first speed of said cutting head shaft at a given drive motor RPM, and c. means for selectively positioning said collar in a second position on said fixed shaft whereby a second diameter idler gear and a second diameter motor drive gear may be placed thereon which will couple said second diameter motor drive gear to said cutting head shaft drive gear to obtain a second gear ratio and a second speed of said cutting head shaft at said given drive motor RPM.

6. An improved mining machine as claim 1 wherein said rotary cutting head comprises:

a. a shaft, b. first and second drive gears removably attached to said shaft, c. first and second bearings removably attached to said shaft for mounting in said cutting head support housing in said forward end of said frame assembly, d. first and second C-shaped end caps placed over said first and second bearings respectively, said end caps being removably attached to said cutting head support housing to rigidly secure said bearings and shaft to said cutting head support housing, e. third and fourth C-shaped end caps placed over said first and second drive gears respectively in a fluid tight relationship for removable attachment to said cutting head support housing thereby forming a sealed compartment about each of said first and second drive gears, f. a first and second chain sprocket assembly placed on each side of said third and fourth end caps for receiving a chain assembly having cutting bits thereon, and g. first and second cutting elements removably attached to said shaft one on either side of said first and second drive gears respectively and having cutting bits thereon, said first and second cutting elements being cylindrical in shape and encircling said cutting head shaft and covering said first and second end caps respectively.

7. An improved mining machine as in claim 6 further including:

a. third and fourth cutting elements having cutting bits thereon, each removably attached to the outer end of a respective one of said first and second cutting elements for rotation, and b. said third and fourth cutting elements being cylindrical in shape and encircling said cutting head shaft.

8. An improved mining machine as in claim 4 further including:

a. a gear chamber on the forward end of said frame assembly for receiving said cutting head drive gear, b. a substantially C-shaped end cap placed over said cutting head shaft drive gear and fastened to said gear chamber for encasing said cutting head shaft drive gear in a fluid tight relationship.

c. a chain sprocket assembly attached to said shaft on either side of said gear chamber and matching C-shaped end cap encasing said gear, d. an idler chain roller rotatably mounted on said frame assembly, e. an endless chain coupling said idler roller to said chain sprocket assembly for movement when said cutting head shaft rotates, and f. cutting bits attached to said chain whereby said rotary cutting head has continuous cutting from one end thereof to the other.

9. A method of improving a mining machine having a frame assembly pivotally attached to said machine and a rotary cutting head mounted on a shaft on the forward end of said frame assembly and having cutting bits thereon for cutting loose mining material from the face of a mine, the improvement comprising the steps of:

a. forming at least one rigid cutting head support housing on the forward end of said frame assembly with a removable C-shaped housing assembly for mating with said rigid support housing to form a unitary housing assembly which holds a shaft bearing, b. forming a rotary cutting head on a shaft with at least one bearing and one drive gear rigidly attached to said shaft, c. mounting said cutting head shaft bearing in said rigid cutting head support housing and mating said C-shaped removable housing assembly with said rigid support housing forming a unitary housing assembly to encase said bearing and to hold said cutting head shaft for rotation with respect to said frame assembly whereby said cutting head may be removed from said unitary assembly for repair at the site where said mining is taking place without lateral movement of said shaft by removing said removable C-shaped mating housing assembly, and d. coupling power to said shaft drive gear for rotating said cutting head for cutting mining material.

10. A method as in claim 9 further comprising the steps of:

a. forming a second bearing on said cutting head shaft, b. mounting said second bearing in a second rigid cutting head support housing, c. mating a second C-shaped removable housing assembly with said second rigid support housing to form a second unitary housing assembly to encase said second bearing, d. forming first and second cutting elements having cutting bits thereon, and e. removably attaching said first and second cutting elements to said shaft, said first and second cutting elements being cylindrical in shape and encircling said cutting head shaft and respectively covering said first and second unitary housing assemblies for said first and second bearings, whereby said first and second cutting elements and said shaft bearing and shaft may be removed from said frame assembly and repaired at the site where said mining is taking place.

11. A method as in claim 10 further comprising the steps of:

a. forming third and fourth cutting elements having cutting bits thereon, and b. removably attaching said third and fourth cutting elements to the outer ends of a respective one of said first and second cutting elements for rotation, said third and fourth cutting elements being cylindrical in shape and encircling and supported by said cutting head shaft.

12. A method of coupling power to said cutting head shaft as in claim 9 further including the steps of:

a. coupling a drive motor to said drive gear, b. forming an idler gear on a rigid shaft for coupling said motor driven gear to said cutting head shaft drive gear, c. mounting an eccentric collar about said idler gear fixed shaft, d. rotatably positioning said collar in a first location on said fixed shaft whereby a first diameter idler gear wheel placed thereon will couple a first diameter motor drive gear to said cutting head shaft drive gear to obtain a first gear ratio and a first speed of said cutting head shaft at a given drive motor RPM, and e. selectively rotatably positioning said collar in a second location on said fixed shaft whereby a second idler gear of different diameter placed thereon will couple a second diameter motor drive gear to said cutting head shaft drive gear to obtain a second gear ratio and a second speed of said cutting head shaft at a given drive motor RPM.

13. An improved method of mining material with a mining machine having a frame assembly pivotally attached to said machine and a rotary cutting head shaft assembly mounted on the forward end of said frame assembly for cutting loose mining material from the face of a mine and extending beyond each side of said frame assembly, the improvement comprising the steps of:

a. forming said cutting head assembly with a shaft and at least first and second removable cutting elements attached thereto, said cutting elements being cylindrical in shape and having cutting bits on the outer surface thereof and removably encircling said shaft, said shaft including at least one bearing and at least one drive gear, b. mounting said cutting head assembly on the outer end of said frame assembly by placing said shaft bearing in a first half of a bearing support integrally formed on the outer end of said frame assembly and mating a second half of said bearing support to said first half to encase said bearing and hold said shaft in a rotatable relationship with said frame assembly whereby said cutting head may be disassembled without lateral movement of said shaft and repaired at the site where the mining is occurring, and c. coupling a drive motor on said frame assembly to said cutting head shaft drive gear for rotating said cutting head to cut mining material.

14. A method of improving a mining machine having a frame assembly pivotally attached to said machine and a rotary cutting head shaft assembly mounted on the forward end of said frame assembly for cutting loose mining material form the face of a mine and extending beyond each side of said frame assembly, the improvement comprising the steps of:

a. mounting at least one bearing on said cutting head shaft for enabling rotation of said shaft, b. forming at least one C-shaped bearing support housing on the forward end of said frame assembly for receiving said bearing on said shaft, c. attaching a matching removable C-shaped bearing support end cap to said frame assembly C-shaped bearing support housing for encompassing and supporting said shaft bearing for rotation of said shaft whereby said shaft may be removed from said mining machine without lateral movement of said shaft by removing said matching removable C-shaped bearing support housing, and d. coupling a drive means to said cutting head shaft to provide rotary motion thereto for cutting mining material.

* * * * *